United States Patent [19]

Leonard et al.

[11] Patent Number: 4,614,550

[45] Date of Patent: Sep. 30, 1986

[54] THERMOMECHANICAL TREATMENT PROCESS FOR SUPERALLOYS

[75] Inventors: Alain R. Leonard, Saint-Michel; Jannick, J.-M. L. Leray, Saint-Germain-les-Corbeil, both of France

[73] Assignee: Societe Nationale d'Etude et de Construction de Meteurs d'Aviation S.N.E.C.M.A., Paris, France

[21] Appl. No.: 683,514

[22] Filed: Dec. 19, 1984

[30] Foreign Application Priority Data

Dec. 21, 1983 [FR] France ..... 83 20436

[51] Int. Cl.[4] ..... C22F 1/10

[52] U.S. Cl. ..... 148/11.5 N; 148/12.7 N; 148/410

[58] Field of Search ..... 148/11.5 N, 12.7 N, 148/410

[56] References Cited

U.S. PATENT DOCUMENTS 3,676,225 7/1972 Owczarski et al. ..... 148/410

*Primary Examiner*—R. Dean

*Attorney, Agent, or Firm*—Oblon, Fisher, Spivak, McClelland & Maier

[57] ABSTRACT

Thermo-mechanical treatment of superalloys enabling simultaneously the production of a structure which is fine and homogeneous, with work hardened grains, a reduction in the stresses resulting from cooling and the absence of parasitic phase ($Ni_3Nb$-$\delta$ in the form of platelets for the Ni bases), characterized by an isothermal aging of predetermined duration after deformation in the final shaping sequence and in the finishing sequence which is followed by a limited amount of deformation and by a final heat treatment constituted solely by annealing producing precipitation of the hardening phase, this final treatment being optionally arranged to follow the finishing treatment, or in sequence, after cooling in air.

15 Claims, 22 Drawing Figures

THERMOMECHANICAL TREATMENT PROCESS FOR SUPERALLOYS

BACKGROUND OF THE INVENTION

1. Field of the Invention

This invention relates to a process of thermomechanical treatment applicable to superalloys.

2. Description of the Background

Current economic conditions and the performance required of aircraft turbo-jet engines currently being developed have caused a return to interest in alloys with a nickel base, of the type NC 19 Fe Nb (marketed under the Registered Trademark INCONEL 718).

The relatively low cost, the absence of cobalt in the composition and experience accummulated with these alloys over many years, both by fabrication and by forging and utilisation in engines, have conferred on such alloys a preponderant position among alloys with high performance characteristics, at temperatures which may exceed 650° C. for short durations.

Laboratory studies carried out by the assignee with a view to further improvement in these alloys has shown that an appreciable improvement of certain of the use characteristics, particularly the elastic limit, resistance under low cycle fatigue and creep, can be obtained by the production of fine, homogeneous, microstructures having a residual work-hardening associated with the absence of the phase $Ni_3Nb$-δ (delta) in the form of platelets. Under conventional forging conditions for these alloys, the structure of the forged parts will often appear very heterogeneous. Zones which are slighly wrought with large grains lie alongside areas of the structure which are termed "duplex" (large work-hardened grains and fine grains of recrystallisation) while the thicker parts of the test-pieces, submitted to a sufficient working and to slower cooling after forging, have a recrystallised structure with equiaxial fine grains. This observation has made clear the importance of certain thermo-mechanical treatment parameters, such as temperature, the heating period, the degree of deformation, the method of cooling, etc. in the production of the desired structure, and as a result the achievement of improved mechanical characteristics.

Thus, different ranges of thermo-mechanical treatment have been studied with a view to defining the parameters of the shaping sequences and finishing sequences which enable the development in the alloy NC19 FeNb of homogeneous structures with fine, work-hardened, grains characterized by the absence of platelets of $Ni_3$ Nb-δ, these results being necessarily achieved by a process applicable to the scale of industrial production.

It is important to underline that the current forging conditions for the alloy NC19 Fe Nb, effected by various forging organisations, lead to structures which represent a compromise with respect to the mechanical characteristics of the alloy. The improvement of certain properties may, in practice, give rise to the modification of other characteristics.

Thus, during the finishing sequence a re-heat temperature which is too low gives rise to the continuance of the fine structure due to the preceding sequence, with however, precipitation of the phase $Ni_3$ Nb-δ in the grain boundaries or, under certain conditions, within the interior of the grains, in the form of platelets preferentially increasing in crystallographic planes of the type {111}. The phase, of orthorhombic structure, is harmful whatever its morphology since it fixes the niobium and thus limits the formation of the hardening phase $Ni_3$ Nb-δ" (second gamma), which is metastable, of quadratic centered structure.

Finally, in the case of the platelet morphology, the phase induces a sensitivity which is more prone to causing fatigue.

Conversely, heating, before forging, to an excessively high temperature, avoids the precipitation of δ phase in platelets, but leads on the contrary to an increase in the grain size, which is liable to reduce the fatigue resistance.

The main value of the process in accordance with the invention arises from the possibility of obtaining fine grained structures, in accordance with sequences of heating/forging simultaneously guaranteeing the absence of platelets of δ phase and the existence of residual work hardening indispensable to the consolidation of the alloy.

The beneficial influence of a fine grain structure on the fatigue resistance of INCONEL 718 is well known to the man skilled in the art. Thus U.S. Pat. No. 3,600,177 proposes a method of refining of the grain based on the precipitation of the $Ni_3$ Nb-δ phase in the core of the grains before the forging operation and the recrystallisation treatment. The precipitation treatment of the phase effected at about 900° C., prior to forging, leads to a subdivision of the grains by the platelets of δ phase which form in planes of the type {111}. The thermal treatment effected after forging with the reduction in the thickness of 50 to 65%, leads to a spheroidal phase of deformed platelets of δ phase and a recrystallisation of the structure. This method enables the production of recrystallised structures, of 10 ASTM or more termed "Minigrain", of which the fatigue characteristics are improved, but of which the resistence to creep and the strength are notably insufficient for a material having good characteristics, necessary for certain industrial applications.

The conditions researched in the particular case of an alloy of the type NC 19 Fe Nb marketed under the Registered Trademark INCONEL 718 apply also for superalloys with hardening by precipitation, in general, and of which those with a nickel base constitute a subclass.

As a consequence, the present invention defines the thermodynamic parameters which enable the achievement of an improvement in all of the mechanical characteristics of these superalloys. In order to ensure industrial reproduceability and the achievement of optimum results, a rigorous control is essential during all of the fabrication processes, having regard to the forging parameters and of the thermal treatment cycles. In particular, the temperature and the amount of deformation in the finishing sequence must be well defined in order to avoid the growth of grains and the precipitation of a parasite phase, but to generate in the core of the grains a sub-structure of dislocations. In practice, in order to achieve these objectives, the method claimed by the invention must enable the satisfaction of four criteria of which known processes up to the present time do not permit simultaneous achievement:

(1) Fine and homogeneous structure;

(2) Work-hardened grains;

(3) Reduction in the stresses caused by cooling; and (4) The absence of a parasite phase.

SUMMARY OF THE INVENTION

According to the present invention, there is provided a thermomechanical treatment process for superalloys in which hardening is effected by precipitation, comprising a sequence of final shaping, a finishing sequence and a final heat treatment, wherein the steps of the process taken in sequence comprise, in the final shaping sequence:

(a) a heating operation, (b) a deformation operation by compression under hot conditions, the temperature conditions and the duration of the heating being determined and the degree of deformation sufficiently high being applied in order to produce a structure of a duplex type during the course of recrystallisation, (c) a thermal treatment consisting of isothermal aging of which the temperature and the aging time are determined in order to achieve a homogeneous structure, of 7 ASTM or more and in which no parasitic phase is precipitated; in the finishing sequence (which follows the preceding stages of the final shaping sequence):

(d) a deformation operation by compression when hot of which the degree of deformation is limited in such a manner that work hardening of the homogenous structure is effected, preceding the production of fine grains by slight deformation in a manner such as to consolidate the structure without giving rise to the phenomenon of recrystallisation;

and, in the final heat treatment, the sole step constituted by:

(e) an annealing treatment which enables the work hardened structure to be maintained and to cause a precipitation of the hardening phase under predetermined treatment conditions for the superalloy under consideration, in the absence of any parasitic phase.

Preferably, a degree of deformation lying between 30% and 60%, preferably 45%, is effected during the hot deformation operation by compression which is incorporated in the final shaping sequence, since an amount of deformation of the order of 8% to 25% is effected in the finishing sequence.

In the application of the process, in accordance with the invention, to superalloys which harden by precipitation and which have a nickel base, the parasite phase, of which the appearance is avoided during the course of the preceding stages of the process, is a $Ni_3$ Nb of the delta type in the form of platelets.

In the application of the process in accordance with the invention, to an alloy of the type NC 19 Fe Nb known under the Registered Trademark INCONEL 718 the conditions of heating in the final shaping sequence are 1040° C.±10° C. over about fifteen minutes and the isothermal holding is effected at 970° C. over a period of thirty minutes.

DESCRIPTION OF THE PREFERRED EMBODIMENTS

The conditions will now be outlined which enable, by the process in accordance with the invention, the application of an optimum solution to the problem posed which is to obtain simultaneously for a superalloy the following properties:

(a) a fine and homogeneous structure;

(b) work-hardened grains;

(c) a reduction in the stresses resulting from cooling; and (d) the absence of a possible parasite phase and in particular, in the practical example in accordance with the invention relating to INCONEL 718, the absence of platelets of the $Ni_3$ Nb-δ. By observing these conditions advantages which are obtained include in particular good mechanical characteristics.

TABLE

| Composition of Inconel 718 | | | | | | | | |
|---|---|---|---|---|---|---|---|---|
| Metal | Ni | Cr | Fe | Nb + Ta | Mo | Ti | Al | C |
| wt % | base | 19 | 18 | 5 | 3 | 1 | 0.5 | 0.05 |

FINE AND HOMOGENEOUS STRUCTURES

Research carried out with the aim of production of a homogeneous structure, with fine grains, has made clear that three parameters as follows are predominant:

(a) Effect of the degree of deformation

Figure 1:
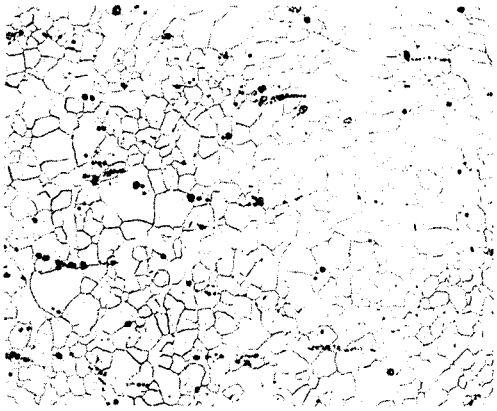
FIGS. 1 and 1A are micro-photographs at two enlargements, respectively 50X and 300X, of a piece of INCONEL 718 providing a grain of 7 ASTM after an isothermal aging period following forging with an amount of deformation of 25%.
Figure 1A:
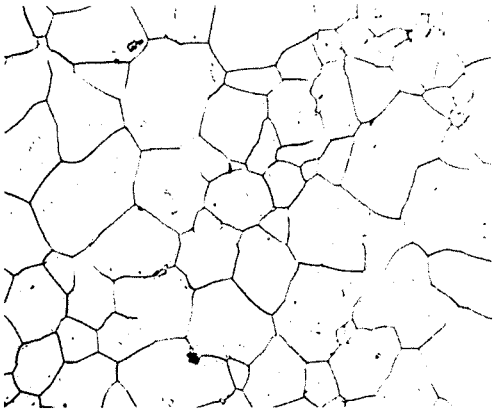
Figure 2:
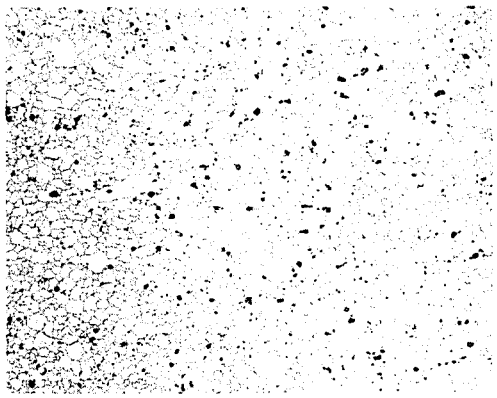
FIGS. 2 and 2A are micro-photographs similar to those of FIGS. 1 and 1A when the amount of deformation is 45% for a grain formed of 8–8.5 ASTM.
Figure 2A:
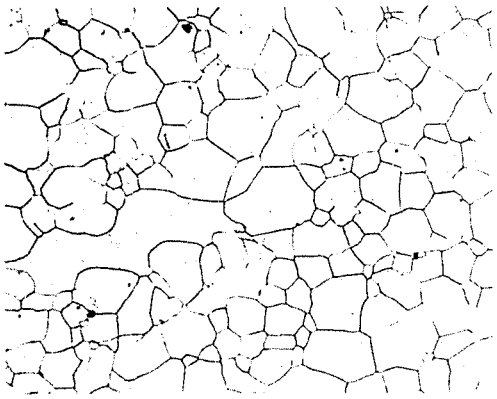
Figure 3:
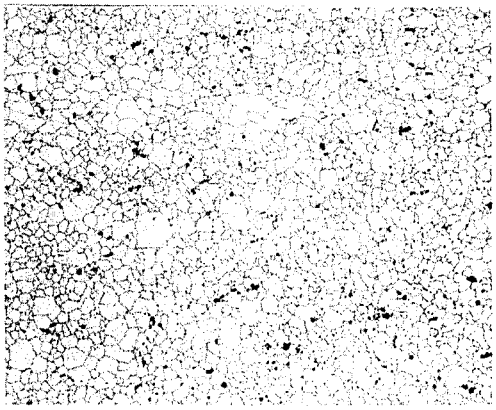
FIGS. 3 and 3A are likewise micro-photographs similar to those of FIGS. 1,1A or 2,2A when the amount of deformation is 60% for a grain produced from 8–8.5 ASTM.
Figure 3A:
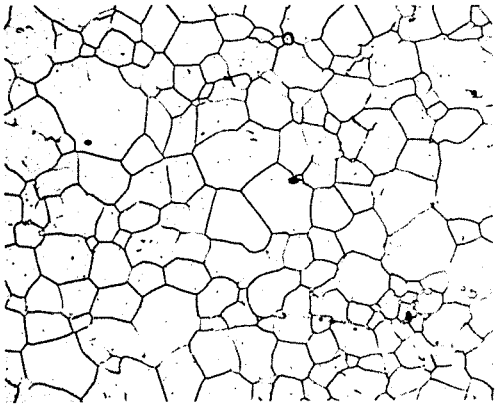

Tests carried out for three degrees of deformation—25-45-60%, effected at 1040° C. and followed by a period of isothermal conditions to effect recrystallisation, have led to the following grain sizes (FIGS. 1 to 3A);

7 ASTM for 25%;

8 and 8.5 ASTM for 45% and 60% respectively;

starting from an initial structure of 3.5 ASTM.

The structure produced is moreover more homogeneous, as a result of a reduction of dead zones. In practice, the rolled parts which cool prematurely in contact with the tool, have, after the isothermal period, a work-hardened structure and recrystallisation grains of which the migration of the boundaries is found to be reversed by the cooling to low temperatures in the recrystallisation zone. The isothermal aging period thus enables the evolution of the microstructure by generalisation of the recrystallisation over the larger part of the test piece. The dead zones are thus reduced, and the structure is rendered finer, since the grain size of the inner portions of the rolled part changes, for example, from 3.5 ASTM to 8-8.5 ASTM after 45 or 60% rolling. The amount of intermediate rolling (45%) associated with the aging period under isothermal conditions to effect recrystallisation, thus ensures the production of a fine and homogeneous structure, of which the third specific requirement resides in the absence of δ phase in platelet form. The economic interest which the inter-relationship between deformation and the isothermal holding period represents, without reverting to the ambient temperature, reinforces the advantage of avoiding the formation of seeds of delta phase, which normally precipitate during cooling and subsequent reheating of the test pieces by passing through the zone during which this phase exists (800°-990° C.).

(b) Effect of the temperature and of the isothermal holding period

For the same forging conditions (1040° C.-45%), isothermal aging conditions have been effected in the zone 960° to 980° C., each over a half hour period.

Figure 4:
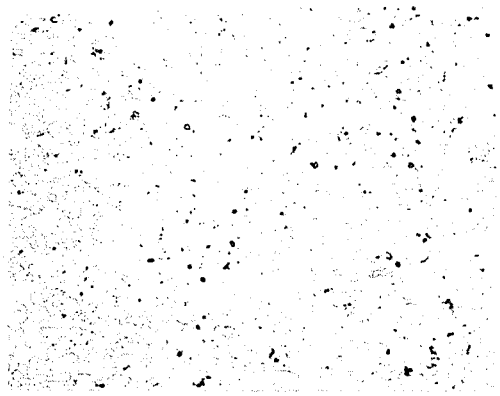
FIGS. 4 and 4A are micro-photographs similar to those of FIGS. 1 and 1A and the following ones, and show a grain of 6–6.5 ASTM following a period under isothermal conditions of 30 minutes at 980° C. after forging with an amount of deformation of 45%.
Figure 4A:
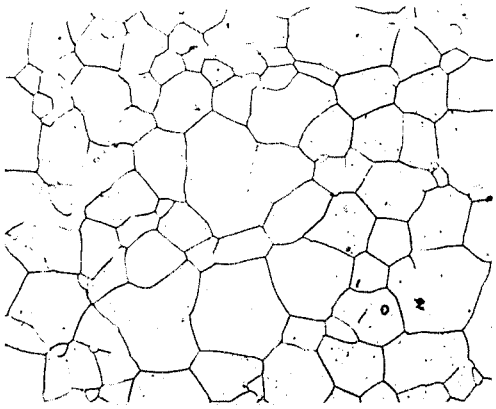
Figure 5:
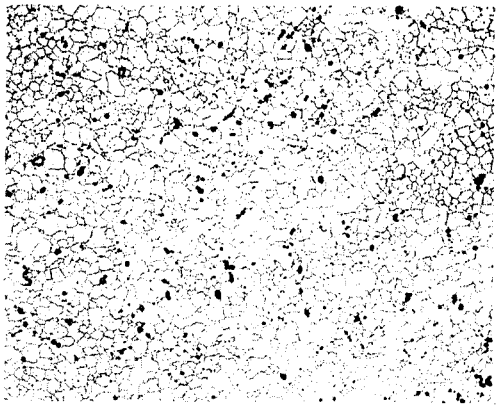
FIGS. 5 and 5A are micro-photographs obtained under the same conditions as those of FIGS. 4 and 4A with the exception that the temperature under isothermal conditions at 970° C. is carried out on a grain of 8 ASTM.
Figure 5A:
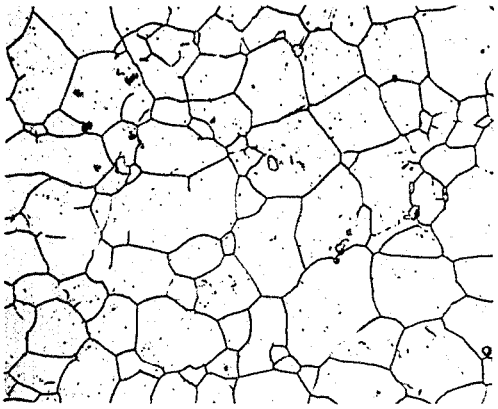
Figure 6:
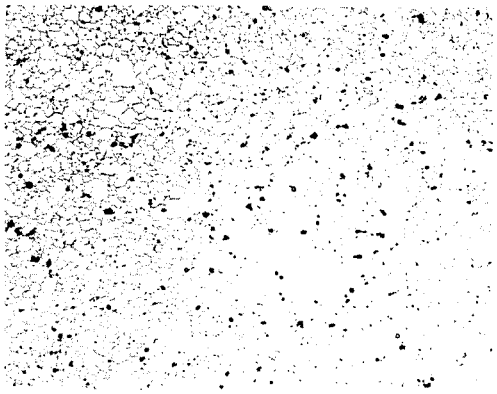
FIGS. 6 and 6A are micro-photographs obtained under the same conditions as those of FIGS. 4,4A and 5,5A with the exception of the temperature maintained under isothermal conditions of 960° C. and carried out on a grain of 8 ASTM.
Figure 6A:
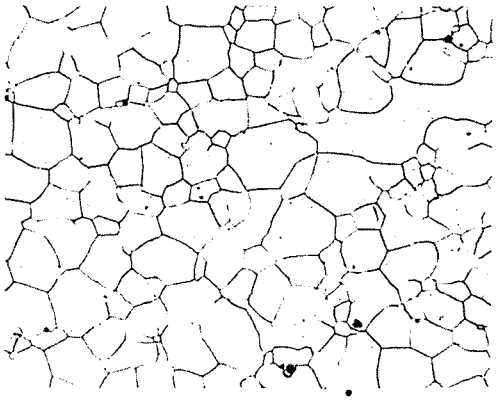

Between 960° and 980° C., the recrystallisation grain passes from 8 to 6-6.5 ASTM, the intermediate temperature 970° C. providing a fine and homogeneous structure, with a grain size of about 8 ASTM (FIGS. 4 to 6A).

These results show the advantage of maintaining the temperature at 970° C., for an isothermal aging period having a duration of about half an hour. This temperature thus enables the acceptance of operational tolerances in industrial furnaces, a fluctuation of ±10° C. thus having an incidence limited to the size of the grains of the recrystallised structure.

With regard to the isothermal aging time, this factor has a moderate effect which has been verified. A prolongation of the isothermal aging period tends to cause an increase in the grain size. However, below a period of one hour at the defined temperatures, no decisive harmful influence has been found taking into account the final result obtained for the finished product. The results which have been the subject of research are obtained for a duration of the aging period substantially of the order of thirty minutes, and under the conditions of industrial application this duration remains always less than one hour.

It will be noted that the refining of the grain size, in accordance with the invention, does not give rise to the disadvantages of the method which is the subject of U.S. Pat. No. 3,660,177 hereinbefore referred to which consists, in particular, in artificially fragmenting the grain by a precipitation of δ phase platelets.

In the process in accordance with the invention, the element niobium is used only for the formation of the hardening phase $Ni_3$ Nb-δ". Only a few seeds of $Ni_3$ Nb-δ phase can be detected by microscopic detection at very high enlargements. The very small volumetric fraction of the seeds and their globular morphology therefore do not have the disadvantageous effects having regard to the mechanical properties.

Work hardening of the grains

On completion of the isothermal aging period, a final deformation is effected. Different degrees of rolling have been tested with a degree of deformation of between 8 and 45%, cooling being effected in the open air.

When the degree of deformation exceeds 25% in the thickness reduction, new recrystallisation seeds are generated and the structure is then constituted by a mixture of fine work-hardened grains and very fine grains of recrystallisation. Their sizes respectively are 8 and 10/11 ASTM.

Figure 7:
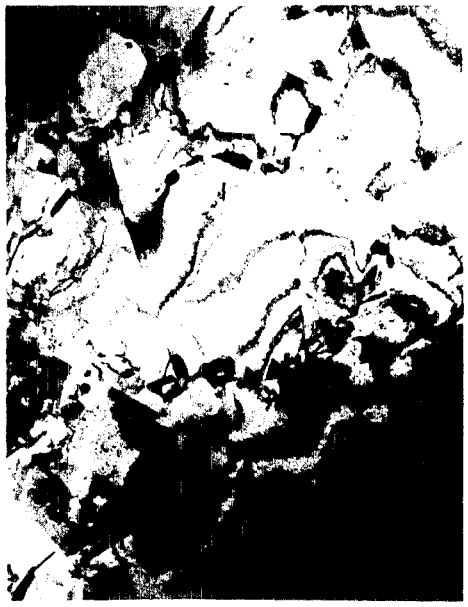
FIG. 7 is a micro-photograph obtained on an electron microscope with a magnification of 3200X of a test piece of INCONEL 718 which has been subjected to the sequences of shaping and finishing in accordance with the invention with a degree of deformation on finishing of 10% exhibiting work-hardened grains and sub-grains.
Figure 7A:
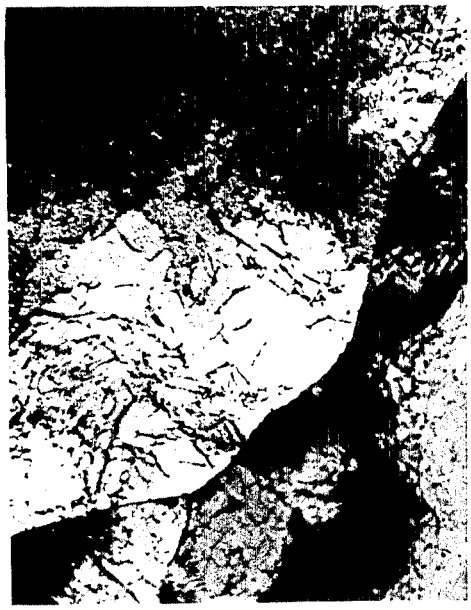
FIG. 7A is a micro-photograph with an enlargement of 25,000X-obtained under the same conditions as those of FIG. 7 and showing an example of sub-boundaries and of sub-grains with pinning of dislocation cracks.
Figure 8:
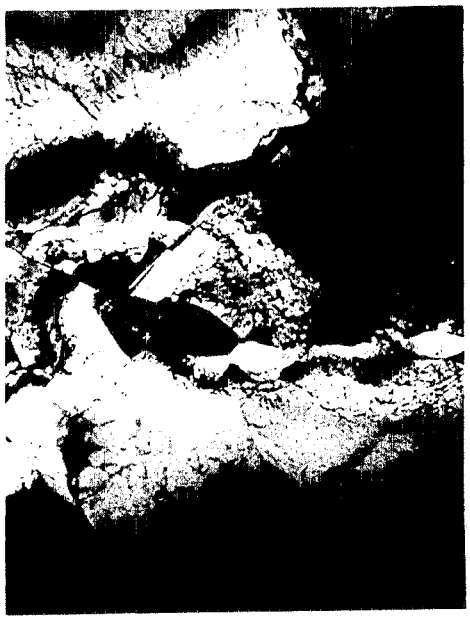
FIG. 8 is a micro-photograph at an enlargement of 6400X of a test piece of INCONEL 718 obtained under the same conditions as those of FIG. 7 with the exception of the amount of deformation during finishing which amounts to 15% showing work-hardened grains and a small recrystallisation grain.
Figure 8A:
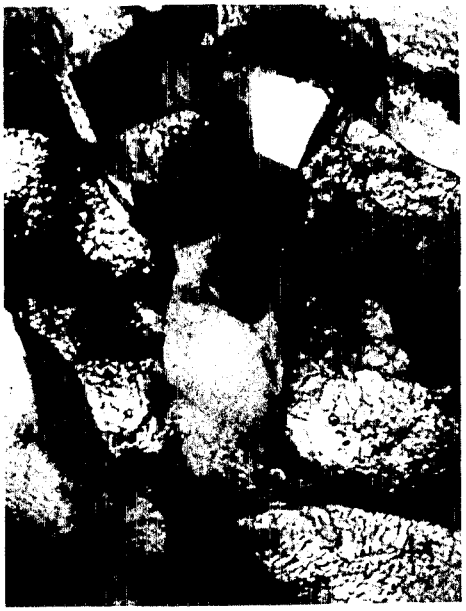
FIG. 8A is a micro-photograph to an enlargement of 25,000X showing a structure, with work-hardened sub-grains similar to those of FIG. 7A and obtained under the same conditions, with the exception in the degree of deformation during finishing which is 15%.

One of the characteristics of the invention is to retain, for the final deformation, degrees of deformation not exceeding 25%. A homogeneous structure is then obtained of 8 ASTM of which the grains have the property of being provided with a network of dislocations which tend, in part, to rearrange themselves as a very fine substructure (about 15 ASTM) similarly work hardened, in the region of the deformed boundaries of the grains (see FIGS. 7,7A, 8 and 8A). The latter structures have mechanical characteristics which are the best, because of the consolidation of the alloy by the dislocations and the substructure associated therewith.

Reduction in the stresses resultant from tempering

It is the current practice in the practical use of the alloy INCONEL 718 under certain forging conditions, to include in the process a water cooling at the end of the hot finishing process. This tempering tends to initiate substantial stresses which are released in a heterogeneous manner during the course of machining and can give rise to substantial deformation, which give rise in turn to costly rejects.

Now, within such thermo-mechanical ranges, the degree of final deformation reaches very high values (about 60%) which is imposed by water cooling in order to moderate the recrystallisation of the deformed structure, intervening in part during cooling of blanks.

Two forms of sequence can be adopted within the scope of the invention as a function of the means available to the forging workshop:

Sequence (a):
Completion of forging,
Return to ambient temperature,
Annealing treatment,
Reversion to the ambient temperature.

Sequence (b):
Completion of forging,
Annealing treatment,
Reversion to the ambient temperature.

The first solution (a) consists in allowing the blank, forged parts to cool down in the open air, on refractory sole-plates without piling one on the other. After cooling down, the parts are subjected to a limited tempering thermal treatment R for precipitation of the δ″ phase.

In the second solution (b) the forged part is directly placed within a furnace, without reverting to the ambient temperature in order to subject it to annealing treatment R.

For INCONEL 718 the annealing treatment applied is one of the known treatments and consists in maintaining a temperature of 720° C. over a period of eight hours following by cooling at a rate of 50° per hour down to 620° with holding at 620° for eight hours, terminated by air cooling.

Absence of δ phase platelets

The thermo-mechanical range, which is the subject of the invention, has enabled the production at the completion of forging of a work hardened structure, with fine grains, free of δ platelet phase. The treatment T at a temperature of 955° C for one hour in air was voluntarily limited to the ranges proposed. In practice, the latter, of which the role must be to ensure homogenisation of the alloy, before the treatment-R-of precipitation of the δ″ phase, leads in practice, on the one hand, to the precipitation more or less pronounced of the δ phase platelets and, on the other hand, to a heterogeneous recrystallisation having as its originating factor a deconsolidation of the alloy.

It will be noted that the residual work hardening produced by the invention enables, amongst other things, the facilitation under certain conditions of the initiation of a minor phase such as $Ni_3$ Nb-δ or δ″. Taking into account the objective which is intended to avoid the precipitation of the δ phase, it is therefore of use to omit the treatment T by which the temperature becomes withing the range of existence of the δ phase. In contrast, the application of annealing, alone, enables maintenance of residual work hardening in the structure. Furthermore, the range of annealing temperatures (720° to 620° C.) corresponds to the unique precipitation of the hardening phase δ″.

Example of ranges in accordance with the invention for INCONEL 718

It will be understood that the ranges only apply to final forging operations and will in no way upset the upstream definition operations.

(1) Shaping sequence (a) Heat the part to 1040° C.±10° C. (50 minutes maintained at this temperature).

(b) Deformation in a press: 45%.

(c) Treatment in the furnace at 970° C. over a period of 30 minutes.

On the completion of this sequence, the shaped part has a homogeneous structure with fine grains.

(2) Finishing sequence

At the completion of the isothermal period, the part is removed from the furnace in order to be directly pressed with an amount of deformation in the range of 8 to 25%.

This small amount of deformation constitutes an important advantage of the process. It enables the use of comparatively low powered tools, which are thus easily available and less costly. On the completion of this sequence the blank has a homogeneous, fine and work hardened set of properties.

(3) Cooling in air

The cooling in air can be effected by either on completion of forging, or on completion of the final thermal treatment on a refractory sole plate (in order to avoid excessively rapid heat exchange).

(4) Annealing

It is effected under standard annealing treatment conditions for INCONEL 718, that is to say:

Aging for eight hours at 720° C. followed by cooling down to 620° C., at a rate of 50° C. per hour, with an aging period for eight hours at this temperature then return to ambient temperature in still air.

COMPARISON OF THE MECHANICAL CHARACTERISTICS OF THE TEST PIECES

Figure 9:
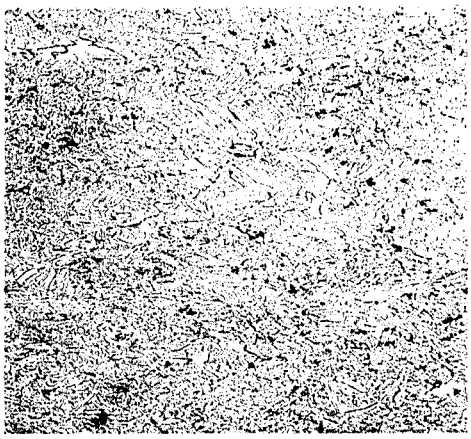
FIGS. 9 and 9A are micro-photographs at two enlargements, respectively fifty times and three hundred times, of a test piece of INCONEL 718 obtained by a method known from U.S. Pat. No. 3,660,177 leading to a structure termed "mini-grain" having a size in the range 10–11 ASTM.
Figure 9A:
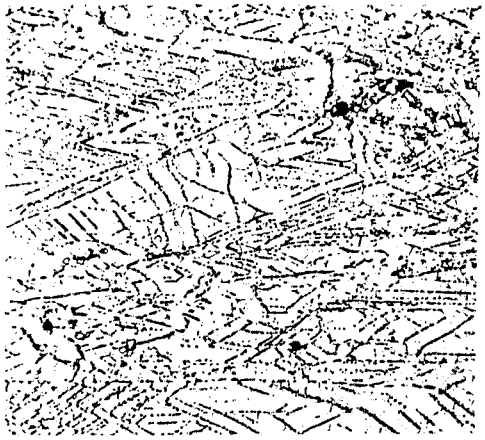
Figure 10:
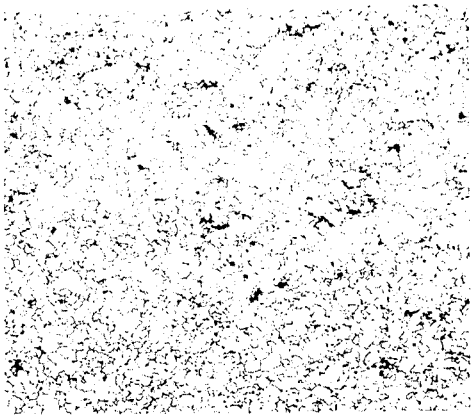
FIGS. 10 and 10A are similar micro-photographs to those of FIGS. 9 and 9A of which the structure is obtained in accordance with a process currently used leading to a fine, recrystallised, grain structure, having a size range 7–8 ASTM.
Figure 10A:
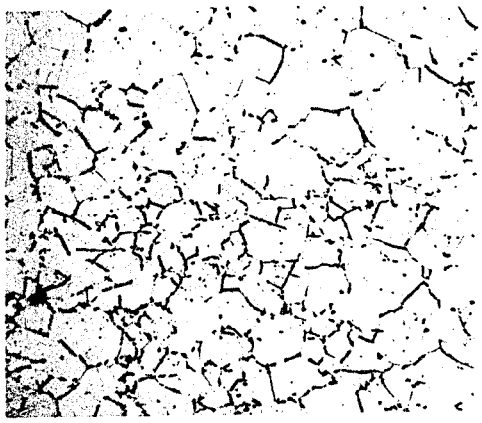
Figure 11:
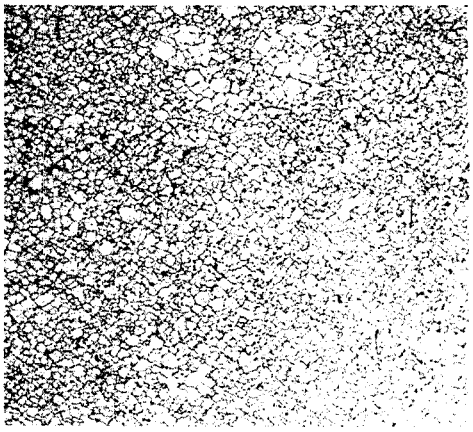
FIGS. 11 and 11A are similar micro-photographs to those of FIGS. 9 and 9A, 10 and 10A and corresponding to a structure obtained by applying the process in accordance with the invention.
Figure 11A:
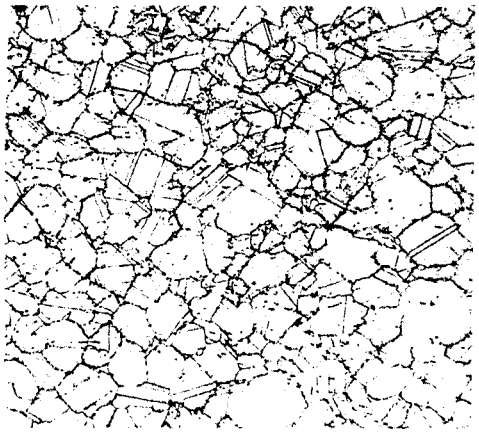

In the tables given hereinafter, comparisons of the main mechanical characteristics of three typical microstructures are set out of INCONEL 718 (see FIGS. 9,9A,10,10A,11 and 11A):

A—"Minigrain" in accordance with U.S. Pat. No. 3,660,177+T′ R (for a grain size of 10/11 ASTM), where T′ corresponds to a heat treatment with a duration of one hour at 980° C. followed by cooling in air.

B—Recrystallisation with fine grain+T.R. (for a grain size of $\frac{7}{8}$ ASTM) where T corresponds to a heat treatment with a duration of one hour at 955° C. followed by cooling in air.

C—In accordance with the range proposed by the invention (for a grain size of 8 ASTM).

(a) TENSION CHARACTERISTICS AT 20° AND AT 650° C. ($\phi$=4.5 mm; lo=23 mm)

| | R (MPa) | | $R_{0,2}$ (MPa) | | A % | | Z % | |
|---|---|---|---|---|---|---|---|---|
| Structure | 20° C. | 650° C. | 20° C. | 650° C. | 20° C. | 650° C. | 20° C. | 650° C. |
| A | 1460 | 1180 | 1210 | 980 | 19,5 | 16,5 | 39,5 | 30 |
| B | 1430 | 1170 | 1250 | 1075 | 15 | 15,5 | 27 | 31 |
| C | 1480 | 1220 | 1390 | 1155 | 14,7 | 17 | 34,8 | 37,2 |

(b) CREEP-RUPTURE CHARACTERISTICS AT 650° C. ($\phi$=4.5 mm; lo=23 mm)

at $\delta$=750 Mpa

| Structure | A | B | C |
|---|---|---|---|
| $t_r$ (h) | 78 | 94 | 316 |
| A % | 7,5 | 7,5 | 14,5 |
| Z % | 17,5 | 17,5 | 25 |

(c) LOW CYCLE FATIGUE CHARACTERISTICS AT 650° C.

Endurance limit on deadening with imposed deformation.

Low cycle fatigue tests with longitudinal total deformation imposed have been effected at 650° C. in accordance with a triangular frequency cycle 0.05 Hz with:

$$R\epsilon = \epsilon lt(\text{minimum})/\epsilon lt(\text{maximum}) = -1$$

where $\epsilon$lt is the longitudinal total deformation (elastic+plastic).

The comparison has been made essentially between structures B and C. The results have shown again of 15 to 20% in the endurance limited by C with respect to B.

We claim:

1. In a process for thermodynamically treating a superalloy wherein hardening is effected by precipitation comprising final shaping, finishing and final heating steps, the improvement wherein the final shaping step comprises the following sequence of steps:

(a) heating the superalloy at between about 960° C. and 1050° C. for between about 15 and 60 minutes;

(b) deforming the thus heated superalloy by hot compression to attain a degree of deformation of about ≧30, the heating being at a temperature and for a period of time and a degree of deformation effective to produce a duplex-type recrystallization structure;

(c) isothermally treating the thus deformed superalloy at a temperature of about >960 for a period of time of between about 30 and 60 minutes;

(d) deforming the treated superalloy by hot compression at a temperature and for a period of time effective to attain a degree of deformation of between about 8 and 25%; and (e) annealing the thus deformed superalloy at a temperature and for a period of time effective to attain a homogeneously precipitated structure having grains of about ≧6 ASTM and lacking a parasitic phase.

2. The process of claim 1, wherein step (e) is conducted at a temperature of about 720° C. for about 8 hours, then cooling at a rate of 50° C. per hour to about 620° C., maintaining this temperature for about 8 hours and then cooling to ambient temperature.

3. The process of claim 1, wherein the degree of deformation attained in step(b) is between 30% and 60%.

4. The process of claim 1, wherein the degree of deformation attained in step (b) is about 45%.

5. The process of claim 1, which further comprises the following step between steps (d) and (e):

allowing the temperature of the deformed superalloy to cool to ambient temperature.

6. The process of claim 1, wherein the superalloy is a Ni base alloy comprising 19 wt % Cr, 18 wt % Fe, about 5 wt % Nb+Ta, 3 wt % Mo, about 1 wt % Ti, 0.5 wt % Al and 0.05 wt % C.

7. The process of claim 6, wherein the heating temperature of step(a) is between 1030° C. and 1050° C.

8. The process of claim 1, wherein the treating temperature of step(c) is between 960° C. and 980° C.

9. The process of claim 6, wherein the superalloy product obtained has a structure of fine and homogeneous grains of about ≧6 ASTM comprising a $\gamma''$-type hardening phase formed by precipitation of $Ni_3Nb$ in the absence of a parasitic platelet-containing $\delta$-type phase.

10. The process of claim 6, wherein the treating size is about 8 ASTM.

11. The process of claim 1, wherein the treating temperature of step (c) is about 970° C.

12. The process of claim 1, wherein step (e) follows immediately after step (d).

13. The process of claim 1, wherein the annealing of step (e) attains a homogeneously precipitated structure lacking platelets.

14. The process of claim 5, wherein the heating in step (a) is carried out at about 1040° C.

15. The process of claim 2, wherein the superalloy is a Ni base alloy of 19 wt % Cr, 18 wt % Fe, about 5 wt % Nb+Ta, 3 wt % Mo, about 1 wt % Ti, 0.5 wt % Al and 0.05 wt % C and the resulting product has a structure of fine and homogeneous grains of about 8 ASTM comprising a $\gamma''$-type hardening phase formed by precipitation of $Ni_3Nb$ in the absence of a parasitic platelet-containing $\delta$-type phase.

* * * * *

UNITED STATES PATENT AND TRADEMARK OFFICE

CERTIFICATE OF CORRECTION

PATENT NO. : 4,614,550

DATED : September 30, 1986

INVENTOR(S) : Leonard et al

It is certified that error appears in the above-identified patent and that said Letters Patent is hereby corrected as shown below:

| Col. | Line | |
|---|---|---|
| Abstract | 1 | delete "Thermo-mechanical" and insert --Thermomechanical--, |
| 1 | 11 | delete "turbo-jet" and insert --turbojet--, |
| | 16 | delete "accummulated" and insert --accumulated--, |
| | 18 | delete "utilisation" and insert --utilization--, |
| | 23 | delete "alloys has" and insert --alloys have--, |
| | 27 | delete "homogeneous," and insert --homogeneous--, |
| | 32 | delete "slighly" and insert --slightly--, |
| | 40,45 | delete "thermo-mechanical" and insert --thermomechanical--, |
| 2 | 22 | delete "well known" and insert --well-known--, |
| | 24 | delete "3,600,177" and insert --3,660,177--, |
| | 37 | delete "resistence" and insert --resistance--, |
| | 51 | delete "reproduceability" and insert --reproducibility--, |
| | 57 | delete "well defined" and insert --well-defined--, |
| | 60 | delete "sub-structure" and insert --substructure--, |
| 5 | 36 | delete "generalisation" and insert --generalization--, |
| | 47 | delete "inter-relationship" and insert --interrelationship--, |

UNITED STATES PATENT AND TRADEMARK OFFICE

CERTIFICATE OF CORRECTION

PATENT NO. : 4,614,550

DATED : September 30, 1986

INVENTOR(S) : Leonard et al

It is certified that error appears in the above-identified patent and that said Letters Patent is hereby corrected as shown below:

| Col. | Line | |
|---|---|---|
| 5 | 51 | delete "delta" and insert --δ--, |
| | 60 | delete "half hour" and insert --half-hour--, |
| 6 | 64 | delete "deformation" and insert --deformations--, |
| | 66 | delete "thermo-mechanical" and insert --thermomechanical--, |
| | 68 | delete "which is" and insert --which are--, |
| 7 | 17 | delete "sole-plates" and insert --soleplates--, |
| | 25 | delete "consists in" and insert --consists of--, |
| | 27 | delete "following" and insert --followed--, |
| | 32 | delete "thermo-mechanical" and insert --thermomechanical--, |
| | 38-39 | delete "homogenisation" and insert --homogenization--, |
| | 52 | delete "withing" and insert --within--, |
| 8 | 43 | delete "of INCONEL" and insert --for INCONEL--, |
| 9 | 42 | delete "960 for" and insert --960°C for--, |
| 10 | 9 | delete "step(b)" and insert --step (b)--, |
| | 22 | delete "step(a)" and insert --step (a)--, |
| | 24 | delete "step(c)" and insert --step (c)--, |
| NOTE: | | delete "recrystallisation" and insert --recrystallization--, throughout |
| 3 | 23-24 | delete "sequence):" and insert --sequence);--, |

UNITED STATES PATENT AND TRADEMARK OFFICE

CERTIFICATE OF CORRECTION

PATENT NO. : 4,614,550

DATED : September 30, 1986

INVENTOR(S) : Leonard et al

It is certified that error appears in the above-identified patent and that said Letters Patent is hereby corrected as shown below:

NOTE: delete "Minigrain" and insert --mini-grain--, throughout,

NOTE: delete "NC19 FeNb" and insert --NC 19 Fe Nb--, throughout,

NOTE: delete "NC19 Fe Nb" and insert --NC 19 Fe Nb--, throughout,

NOTE: delete "$Ni_3NB$-δ" and insert --$Ni_3$ NB-δ--, throughout,

NOTE: delete "work hardened" and insert --work-hardened--, throughout,

NOTE: delete "work hardening" and insert --work-hardening--, throughout,

NOTE: delete "micro-photographs" and insert --microphotographs--, throughout

| Col. | Line | |
|---|---|---|
| 4 | 43 | delete "fifty times" and insert --50X--, |
| | 43-44 | delete "three hundred times" and insert --300X--, |
| 7 | 39 | delete "treatment-R-of" and insert --treatment R of--, |
| 8 | 29 | delete "sole plate" and insert --soleplate--, |
| 8 | 63 (table) | delete "19,5" and insert --19.5--, |
| | | delete "16,5" and insert --16.5--, |
| | | delete "39,5" and insert --39.5--, |

UNITED STATES PATENT AND TRADEMARK OFFICE

CERTIFICATE OF CORRECTION

PATENT NO. : 4,614,550

DATED : September 30, 1986

INVENTOR(S) : Leonard et al

It is certified that error appears in the above-identified patent and that said Letters Patent is hereby corrected as shown below:

| Col. | Line | |
|---|---|---|
| 8 | 65 (table) | delete "14,7" and insert --14.7--, |
| | | delete "34,8" and insert --34.8--, |
| | | delete "37,2" and insert --37.2--, |
| 9 | 8 (table) | delete "7,5" and insert --7.5--, under both A & B, |
| | | delete "14,5" and insert --14.5--, |
| | 9 | delete "17,5" and insert --17.5--, under both A & B, |

Signed and Sealed this

Sixteenth Day of August, 1988

*Attest:*

DONALD J. QUIGG

*Attesting Officer*

*Commissioner of Patents and Trademarks*